US007701319B2

(12) United States Patent
Kitamura et al.

(10) Patent No.: US 7,701,319 B2
(45) Date of Patent: Apr. 20, 2010

(54) INDUCTOR ELEMENT AND METHOD OF MANUFACTURING THE SAME

(75) Inventors: Kazumasa Kitamura, Ichinomiya (JP); Yoshinori Yamaguchi, Nagoya (JP)

(73) Assignee: NGK Insulators, Ltd., Nagoya-Shi (JP)

( * ) Notice: Subject to any disclaimer, the term of this patent is extended or adjusted under 35 U.S.C. 154(b) by 103 days.

(21) Appl. No.: 11/853,860

(22) Filed: Sep. 12, 2007

(65) Prior Publication Data

US 2008/0084265 A1 Apr. 10, 2008

(30) Foreign Application Priority Data

Oct. 4, 2006 (JP) ..... 2006-272721

(51) Int. Cl.
*H01F 5/00* (2006.01)

(52) U.S. Cl. ..... 336/200

(58) Field of Classification Search ..... 336/65, 336/83, 200, 206–208, 232–234; 257/531
See application file for complete search history.

(56) References Cited

U.S. PATENT DOCUMENTS 770,432 A * 9/1904 Kinraide ..... 336/182
6,169,470 B1 * 1/2001 Ibata et al. ..... 336/83
6,413,340 B1 7/2002 Anbo et al.
7,176,773 B2 2/2007 Shoji
7,205,876 B2 * 4/2007 Lee et al. ..... 336/200
2001/0054472 A1 12/2001 Okuyama et al.
2004/0164835 A1 8/2004 Shoji
2005/0212642 A1 9/2005 Pleskach et al.

FOREIGN PATENT DOCUMENTS

| | | | |
|---|---|---|---|
| EP | 0 953 994 | | 11/1999 |
| EP | 1 253 607 | | 10/2002 |
| JP | 07-326515 | A1 | 12/1995 |
| JP | 08-169776 | A1 | 7/1996 |
| JP | 09-199370 | A1 | 7/1997 |
| JP | 10-012455 | A1 | 1/1998 |
| JP | 2000-188225 | A1 | 7/2000 |
| JP | 2001-167930 | A1 | 6/2001 |
| JP | 2002-171064 | A1 | 6/2002 |
| JP | 2004-253684 | A1 | 9/2004 |
| JP | 2005-142302 | A1 | 6/2005 |

* cited by examiner

*Primary Examiner*—Tuyen Nguyen
(74) *Attorney, Agent, or Firm*—Burr & Brown

(57) ABSTRACT

An inductor element comprises: a ceramic base member; and a coil composed of a conductor having a shape complementary to the ceramic base member. In the inductor element, a prescribed plural number of steps are formed on at least an inner wall surface of the ceramic base member facing to the coil in one direction.

9 Claims, 4 Drawing Sheets

INDUCTOR ELEMENT AND METHOD OF MANUFACTURING THE SAME

BACKGROUND OF THE INVENTION

1. Field of the Invention

The present invention relates to an inductor element as a base part for configuring an electric/electronic circuit, and a method of manufacturing the same.

2. Description of the Related Art

As the advancement in the weight lightening and the multi-functionality in the mobile devices such as a cellular phone, the mobile devices become an indispensable tool for daily life. As a consequence, electric/electronic parts constituting the mobile device are under developing, with aiming at enhancing the response speed, minimizing the size, thinning the thickness, and saving the energy more as a main technical theme. This phenomenon is also applicable to the inductor as one of the fundamental parts for the mobile devices, which ranks with the resistor and the capacitor.

Examples of the related art regarding the inductor include JP-A-2001-167930, and JP-A-2004-253684 and Japanese Patent No. 3662749. JP-A-2001-167930 discloses an inexpensive inductor coil that allows a large current to flow therethrough and has a large sectional area. This inductor coil is a developed one of the conventional wound inductors, which is manufactured by a method of laminating metal conductive plates into a spiral shape in place of winding wire so as to reduce a wiring resistance.

Further, JP-A-2004-253684 proposes a high-density inductor. This high-density inductor increases a longitudinal sectional area of the coil to reduce a wiring resistance and repeating a photo-etching step and a plating deposition step to laminate wiring layers to attain a high-density coil structure. Further, Japanese Patent No. 3662749 proposes a method of manufacturing a laminate inductor, which involves forming spiral coil patterns and through-holes on a ceramic green sheet by screen printing and then laminating the patterns one on top of the other, followed by a backing to complete an inductor element.

SUMMARY OF THE INVENTION

The present invention has been completed under the above-mentioned circumstances. It is accordingly an object of the present invention to provide a novel inductor element that can meet the recent technical needs and does not belong to any one of conventional wound type, laminate type, or thin-film type. We have made extensive studies and found that the above object can be attained, as discussed below in detail.

That is, the present invention provides an inductor element including: a ceramic base member; and a coil composed of a conductor having a shape complementary to the ceramic base member, in which a prescribed plural number of steps are formed on at least an inner wall surface of the ceramic base member facing to the coil in one direction.

In the inductor element according to the present invention, preferably, a cutout is formed on just below each of the overhung portion of the steps in the same direction as an overhanging direction of each of the steps.

The term "step" in the present specification means an overhung portion defined by the difference at either side of the long base portion of one trapezoid shaped member in section between the lower long base of the trapezoid shaped member, which is laminated on the short upper base of another trapezoid member in section, desirably, the isosceles trapezoid member since at least an inner wall of the ceramic base member should have a shape being composed of a prescribed plural number of the trapezoids, preferably the isosceles trapezoids which is arranged in vertical direction by laminating a prescribed plural number of trapezoid members in section in vertical direction, preferably, the isosceles trapezoid members with keeping their respective long bases at the bottom side.

The step dimension in horizontal direction of the inductor element according to the present invention is preferably 1.6 to 16 μm, more preferably, 3 to 10 μm, and particularly preferably 6 μm.

In the inductor element according to the present invention, if a cutout is formed on at least one of corners of each upper base of the trapezoids contacting the lower base of the trapezoids laminated thereon, the cutout preferably has a dimension that is ⅕ to 1/200 of the maximum width of the ceramic base member in the same direction as a direction of cutting the corner to form the cutout. The cutout dimension is more preferably ⅕ to 1/100 of the maximum width of the ceramic base member in the same direction as the cutting direction of the cutout. Hereinafter, the expression "the cutout is formed beneath the step" is used to mean that the cutout is formed on at least one of corners of each upper base of the trapezoids contacting the lower base of the trapezoids laminated thereon.

The cutting direction of the cutout means a direction a parallel to the bases of the trapezoids constituting the ceramic base member as a whole. The cutout dimension means a distance in the cutting direction from the edge of the cutout to the portion where the upper base of the trapezoid contacts intimately with the lower base of the trapezoid laminated on the trapezoid having the cutout; that is, the depth of the cutout.

In the inductor element according to the present invention, if a cutout is formed, the cutout preferably has a dimension of 2 to 20 μm, more preferably 2 to 10 μm.

The inductor element according to the present invention preferably has a square spiral shape.

The present element takes a quadrangular prism shape as a whole because of the square shape, which involves a shape in a winding direction. The coil is similarly wound into a square-cornered spiral shape as viewed in section. On account of the spiral shape, the same coil pattern appears in a section parallel to the winding direction. The expression "the same coil pattern appears" means the same coil sectional shape is obtained in any section of the present inventive inductor parallel to the winding direction.

If the inductor element has a square spiral shape, in the inductor element according to the present invention, a ratio of a length of each of the prescribed plural number of steps in another direction different from the one direction (laminating direction) in which the prescribed plural number of steps are formed to a length of each of the prescribed plural number of steps in the one direction (laminating direction) is preferably 0.4 to 1.0.

If the inductor element of a square spiral shape according to the present invention is explained using the coordinate system, the direction in which the steps are formed is taken as a Z axis direction as shown in FIG. 1, for example, a length thereof in the Z axis direction is DZ, and another direction different from the step formation direction is an X axis direction, and a length thereof in the X axis direction is DX, a ratio of DX to DZ, DX/DZ, is preferably 0.4 to 1.0. Alternatively, provided that another direction different from the step formation direction is a Y axis direction, and the length thereof in the Y direction is DY, a ratio of DY to DZ, DY/DZ, is preferably 0.4 to 1.0.

In the inductor element according to the present invention, a coil is preferably integrally formed. The term the integrally formed coil means that no joined portion exists wherein an adhesive or the like is used for a joint in the coils; in other words, the coil is not one which was manufactured through a bonding step.

The inductor element according to the present invention is preferably manufactured by the following method of manufacturing an inductor element according to the present invention. In this case, a coil is integrally formed. Further, the ceramic base member surrounds the coil, and the coil (conductor) and the ceramic (base member) come into close contact with each other.

Further, the inductor element according to the present invention, which is manufactured by either one of the following methods, a coil is embedded into a cavity (of the ceramic base member) having a prescribed plural number of steps only in one direction. Then, the steps are formed at junctions between ceramic green sheets constituting a (unfired) green laminate for forming a ceramic base member.

In the inductor element according to the present invention, the ceramic base member is a magnetic ceramic base member composed of a magnetic member.

Next, the present inventive inductor element may be manufactured by the one embodiment which comprises: preparing a prescribed plural number of ceramic green sheets; punching out a hole of a predetermined shape in each of the ceramic green sheets; laminating the prescribed plural number of ceramic green sheets each having the hole formed therein to form a green laminate; and firing the green laminate to form a ceramic base member where a coil is integrally formed in a cavity of a coil shape defined by the holes (hereinafter referred to as "first embodiment for manufacturing an inductor element according to the present invention" or "first manufacturing embodiment according to the present invention").

In the case of the first manufacturing embodiment of an inductor element according to the present invention, a coil is formed after the ceramic base member has been formed. That is, firstly, a prescribed plural number of ceramic green sheets including a fine punched (hole) pattern are laminated, and a cavity in the prescribed shape appears in the resultant laminate (green laminate; ceramic base member after firing). Then, the coil is formed as a square spiral shape, for example. The hole is formed through a punching process so that the same coil pattern (for example, square spiral shape) appears on every one section of the laminate.

In the case of the first manufacturing embodiment according to the present invention, a conductive material may be filled into the cavity of the ceramic base member using one method selected from the methods consisting of a printing method employing a metal mask photolithography, dispensing method, dipping method, or the like.

The present inventive inductor element may be produced by the second embodiment which comprises: preparing a prescribed plural number of ceramic green sheets; punching out a hole of a predetermined shape in each of the ceramic green sheets; filling the hole with a conductive material; laminating the prescribed plural number of ceramic green sheets each having the hole filled with a conductive material to form a green laminate; and firing the green laminate to form a ceramic base member where a coil is integrally formed in a cavity of a coil shape defined by the hole (hereinafter referred to as "second embodiment of manufacturing an inductor element according to the present invention" or "second manufacturing embodiment according to the present invention"). Incidentally, the method of manufacturing an inductor element according to the present invention refers to both or either one of the first embodiment of manufacturing an inductor element according to the present invention and/or the second embodiment of manufacturing an inductor element according to the present invention.

In the case of the second manufacturing embodiment of an inductor element according to the present invention, a ceramic base member and a coil are formed simultaneously through firing. A prescribed plural number of ceramic green sheets including a fine punched (hole) pattern and having the hole filled with a conductive material are laminated. At this time, the conductive material has been filled, prior to firing, in a cavity of a coil shape in the resultant laminate (green laminate; ceramic base member after firing). Thus, the laminate is fired to thereby complete the ceramic base member where the coil is formed (into a square spiral shape, for example). In the second manufacturing embodiment as well, the same coil pattern (for example, square spiral shape) can appear on every one section of the laminate if the sheets are appropriately punched out.

In the case of the second manufacturing embodiment according to the present invention, a conductive material may be filled into the hole formed in the ceramic laminated green sheet by a printing method using a metal mask photolithography.

In the method of manufacturing an inductor element according to the present invention, the ceramic green sheet is preferably a magnetic ceramic green sheet composed of a magnetic ceramic material. In this case, the resultant ceramic base member is a magnetic ceramic base member.

In the inductor element according to the present invention, a prescribed plural number of steps are formed at least on an inner wall surface of the ceramic base member facing to the coil in one direction, whereby a thermal stress generated during production or when in use is dispersed by the steps to thereby prevent cracks. Thus, the inductor element according to the present invention can provide a higher reliability for the long term.

The formation of the cracks is a troublesome problem in manufacturing an inductor element. More specifically, when temperature of the fired inductor is lowered from the melting point of a conductive material that forms the coil down towards ambient temperature, cracks develop at an interface between a coil (conductive material) and a ceramic base member due to a difference in degree of thermal expansion, with the result that a product is broken. This is supposedly because a compressive force acts on the ceramic base member due to a difference in thermal expansion coefficient, and if the compressive force exceeds the adhesive strength at the interface, cracks develop at the interface. In the inductor element according to the present invention, since the ceramic base member have steps each of which has a fine structure capable of being elastically deformable, the generated thermal stress can be released or dispersed by the steps deforming, thereby the formation of cracks is prevented.

Even if the arrangement direction of steps does not show any specified directivity, a thermal stress can be dispersed as long as steps are formed. In the case of the present inventive inductor element according to the present inventive manufacturing method, the resulting inductor element is formed to provide the directivity in the specified direction. This is because of how the present inventive inductor element is manufactured, as is discussed hereinafter in detail.

In a preferred mode of the inductor element according to the present invention, a cutout is further formed on each contacting point between the lower base of the trapezoid member disposed above and the upper base of the trapezoid member disposed below in the laminating direction, as is discussed in Paragraph 0010 of the present specification, whereby the steps can be elastically deformed more than the steps without a cutout. That is, the steps can be largely elastically-deformed owing to the cutout.

In a preferred mode of the inductor element according to the present invention, the step dimension is 1.6 to 16 μm, whereby variations in dimension and shape of each step can be suppressed by a punching process to facilitate production. If the step dimension is smaller than 1.6 μm, the dimension is below its limit in terms of dimensional accuracy of a die cutter, and the dimension and shape of each step largely vary.

In a preferred mode of the inductor element according to the present invention, the cutout has a dimension that is 1/5 to 1/200 of the maximum width of the ceramic base member in the same direction as a depth direction of the cutout, whereby the steps can be deformed to prevent almost all cracks even if a thermal stress is generated. If the cutout dimension is larger than 1/5 of the maximum width of the ceramic base member in the same direction as the depth direction of the cutout, the steps cannot be deformed enough, and cracks might undesirably develop.

In a preferred mode of the inductor element according to the present invention, the cutout has a dimension of 2 to 20 μm, whereby the steps can be deformed to prevent almost all cracks even if a thermal stress is generated. If the cutout dimension is smaller than 2 μm, the steps cannot be deformed enough, the thermal stress cannot be released, and cracks might undesirably develop.

In a preferred mode of the inductor element according to the present invention, a ratio of a length of each of the prescribed plural number of steps in another direction different from the one direction (laminating direction) in which the prescribed plural number of steps is formed to a length of each of the prescribed plural number of steps in the one direction is 0.4 to 1.0. This means that the length thereof in a direction where the steps are not formed (another direction different from the laminating direction) is shorter than the length thereof in the direction where the steps are formed (the one direction as the laminating direction). Thus, the generated thermal stress is reduced, and cracks hardly develop. Further, the above mode is preferred as an electric/electronic part of a mobile device since an area to be required to mount the inductor element or the height of the inductor element can be reduced.

The method of manufacturing an inductor element according to the present invention is preferred as a method for manufacturing the inductor element according to the present invention. This method attains beneficial effects as follows: That is, the method can manufacture the inductor element according to the present invention by a simple laminating process including; punching out (ceramic) green sheets to form respectively a hole that cumulatively forms a cavity as a result of defining a coil shape to be formed; laminating thus prepared green sheets; and firing the resultant green laminate.

According to the first manufacturing embodiment as the method of manufacturing an inductor element according to the present invention, a cavity of the ceramic base member that serves as a form is filled with a conductive material, followed by backing to thereby integrally form a coil in the cavity, so a coil sectional area is determined by a cavity shape. Thus, the coil thickness is set to suppress an energy loss even if a large current is supplied, and save power consumption, and an integrally formed inductor with a seamless coil with no adhesive joint or the like can be easily manufactured. Further, if the coil has a square spiral shape, an interval of the square spiral shape can be changed in accordance with the cavity shape, so an inductor with many wire turns can be easily manufactured. Further, according to the first manufacturing embodiment of the present invention, the coil shape can be changed in accordance with the cavity shape, the cavity is formed into a square shape or a plate-like shape to thereby easily manufacture a compact inductor including a coil with a large sectional area (area through which a current flows).

The first and second manufacturing embodiments as the method of manufacturing an inductor element according to the present invention differ only in that in the second manufacturing method, a hole is formed and filled with a conductive material, and then the ceramic green sheets are laminated to form a green laminate, followed by firing to thereby form a ceramic base member and a coil at the same time unlike the first manufacturing embodiment that includes: laminating the ceramic green sheets each having a hole that is not yet filled with a conductive material to form a green laminate; backing the green laminate to form a ceramic base member that serves as a form; and filling the cavity with a conductive material, followed by backing to thereby integrally form a coil in the cavity. That is, the first and second manufacturing embodiments differ only in a timing when a conductive material for forming (a part of) the coil later is filled in the cumulatively formed hole acting as a cavity. However, the first and second manufacturing embodiment are the same in that the coil is integrally formed in the cavity, and the coil shape can be changed in accordance with the cavity shape, so the second embodiment of manufacturing an inductor element according to the present invention can produce similar effects to those of the first embodiment of manufacturing an inductor element according to the present invention.

In the first embodiment of manufacturing an inductor element according to the present invention, a conductive material is filled into a cavity in a ceramic base member that serves as a form after the completion of forming the ceramic base member, and then the ceramic base member is fired. Thus, there are few limitations on the backing temperature and reactivity of the conductive material to be used, so that a conductive material can be selected from various types of materials.

An inductor element according to the present invention can then be used in various applications as an inductor configuring an electric/electronic circuit. For example, the inductor element is preferably used, for example, for a switching power supply or a power supply circuit inductor (choke coil) used in a circuit for converting an energy such as a DC/DC converter, a high-frequency circuit inductor, or a noise-eliminating inductor.

EXPLANATION ON SYMBOLS

Figure 1:
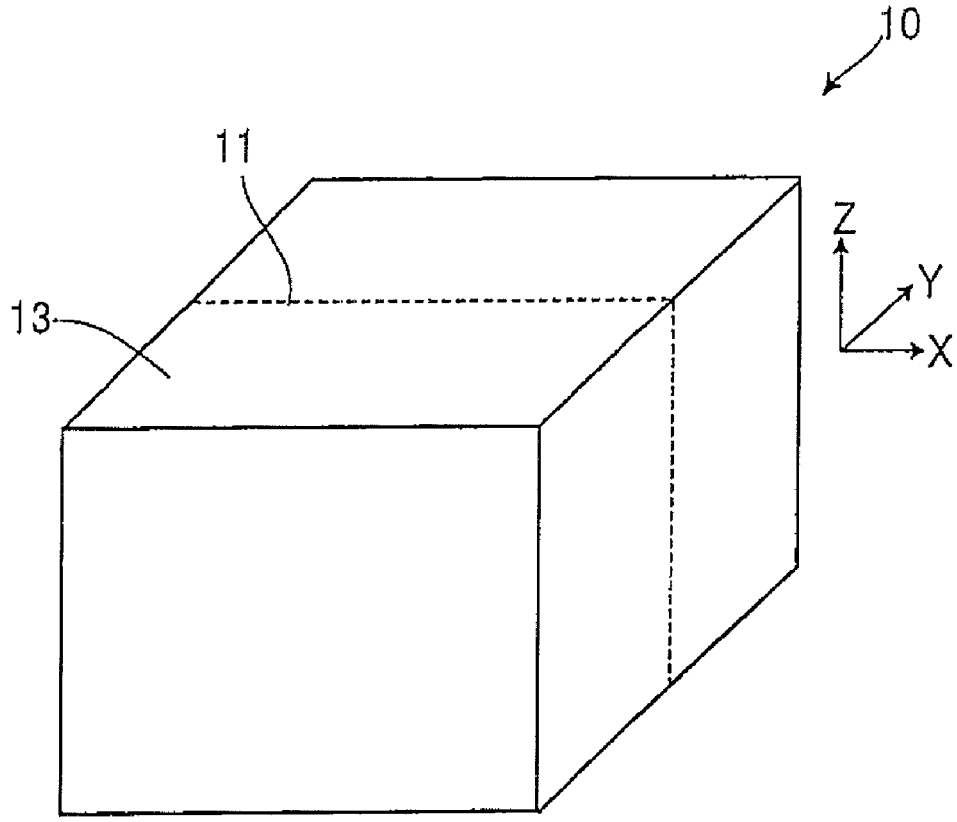
FIG. 1 is a perspective view of an inductor element according to an embodiment of the present invention, from which steps on an outer surface are omitted.

3 . . . supporting portion, 4 . . . cutout, 5 . . . step, 10 . . . inductor element, 11 . . . cutting line, 12 . . . coil, 13 . . . ceramic base member, 14 . . . ceramic layer.

DETAILED DESCRIPTION OF THE INVENTION

Hereinafter, embodiments of the present invention will be described with reference to the accompanying drawings as appropriate, but the present invention should not be construed as being limited to these embodiments. Those skilled in the art will recognize that the embodiments can be variously changed, adjusted, modified, and replaced on the basis of their knowledge without departing from the scope of the present invention. For example, the accompanying drawings illustrate preferred embodiments of the present invention but the present invention is not limited by modes illustrated in the drawings nor information in the drawings. Similar and equivalent means to those incorporated in the specification are applicable in embodying and examining the present invention, but preferred means are as follows.

Figure 2:
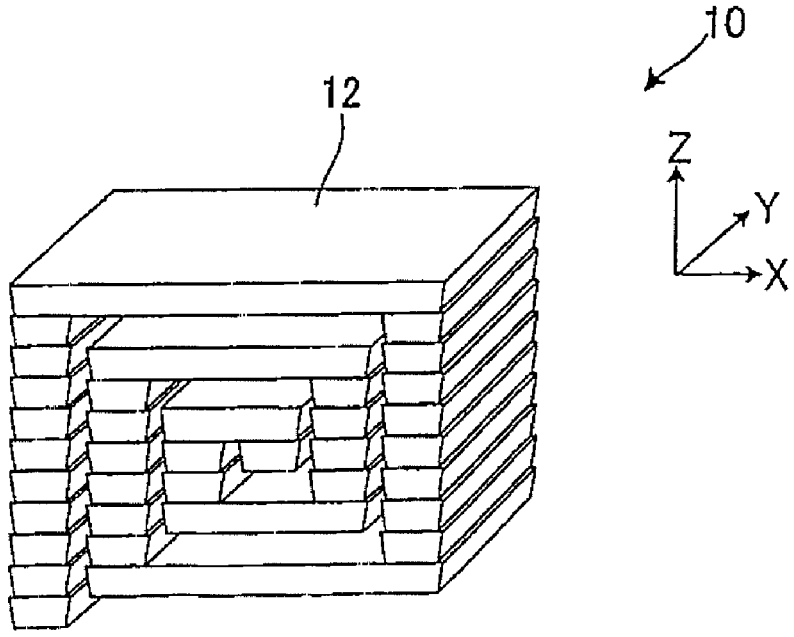
FIG. 2 is a perspective view of an inductor element according to an embodiment of the present invention, which shows a coil inside the element.
Figure 3:
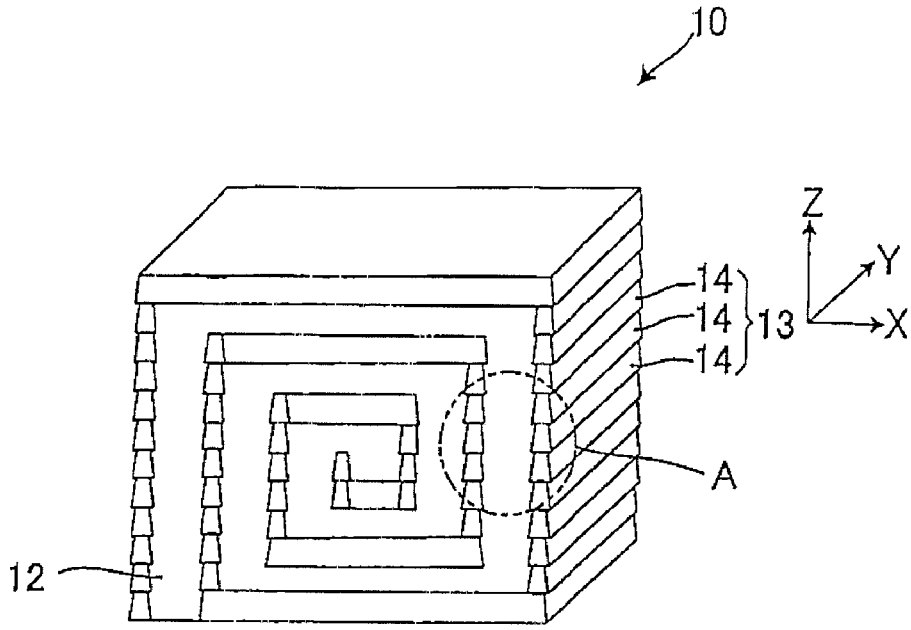
FIG. 3 is a sectional view of an inductor element according to an embodiment of the present invention, which is taken along a predetermined line of FIG. 1.
Figure 4:
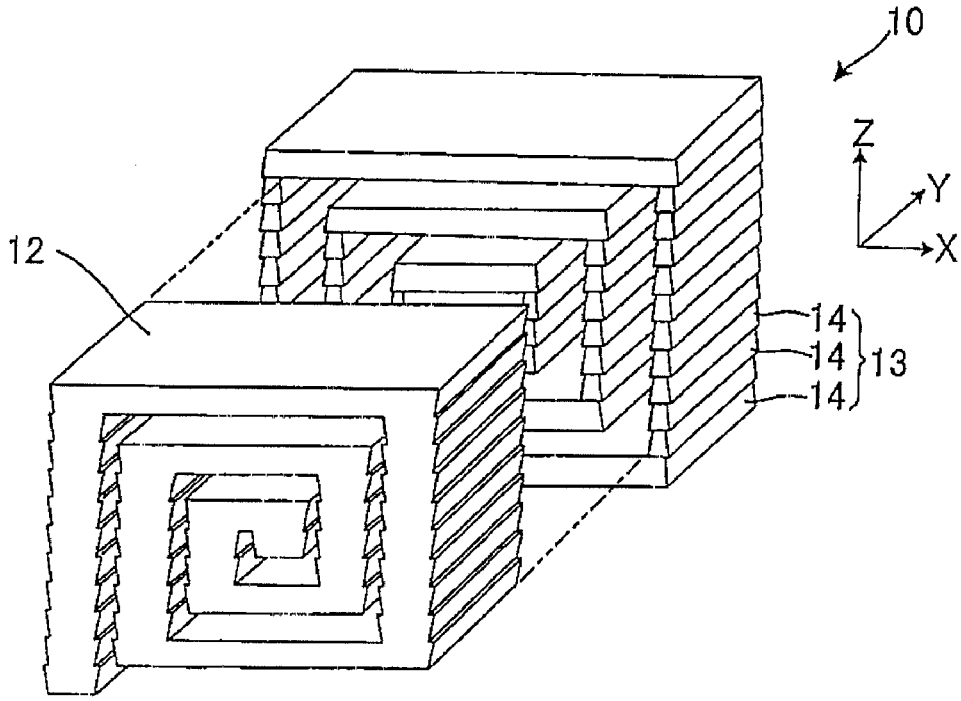
FIG. 4 is a perspective view of an inductor element according to an embodiment of the present invention, which shows how a ceramic base member and a coil are separated in a mode of FIG. 3.
Figure 5:
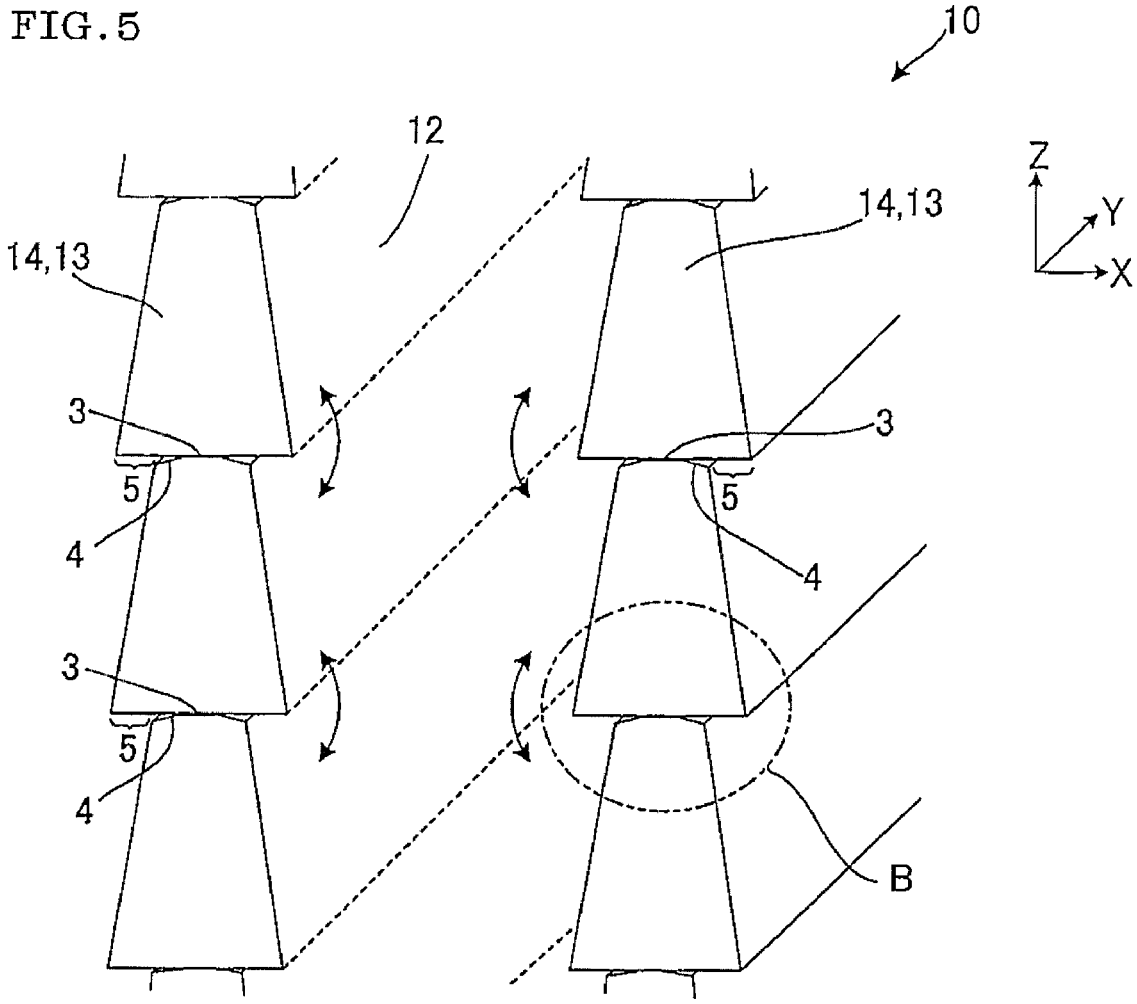
FIG. 5 is a perspective enlarged view of a portion A encircled in FIG. 3 of an inductor element according to an embodiment of the present invention.
Figure 6:
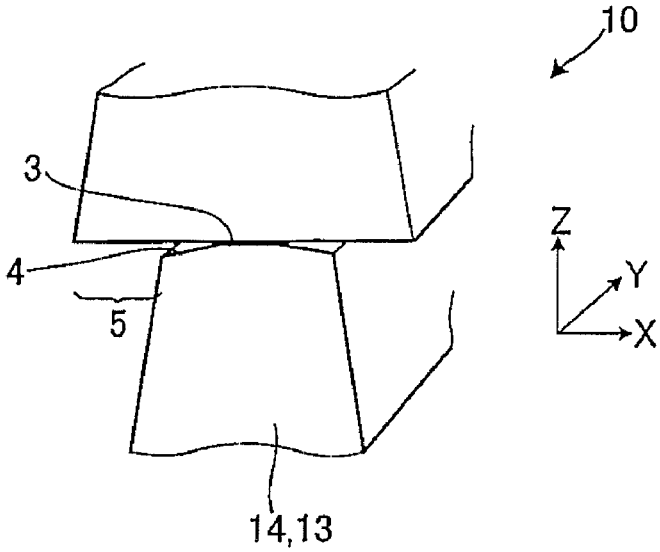
FIG. 6 is a perspective enlarged view of a portion B encircled in FIG. 5 of an inductor element according to an embodiment of the present invention.
Figure 7:
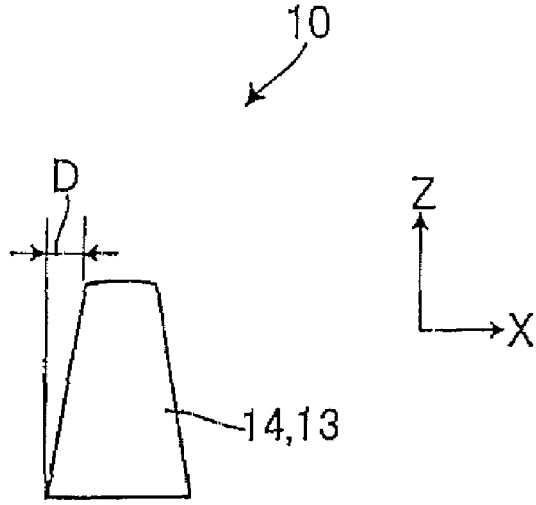
FIG. 7 is a sectional view of an inductor element according to an embodiment of the present invention, which shows a part (one ceramic layer) of a ceramic base member.
Figure 8:
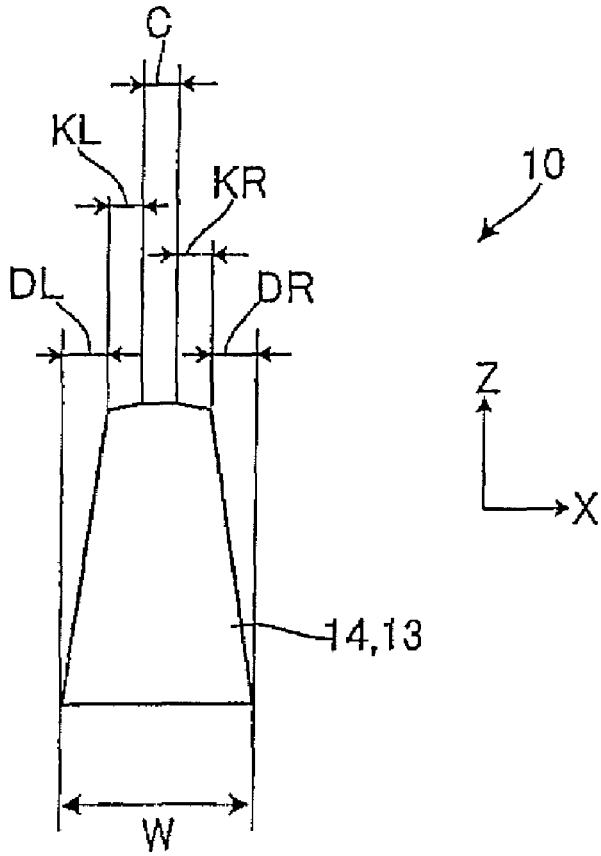
FIG. 8 is a sectional view of an inductor element according to an embodiment of the present invention, which shows a part (one ceramic layer) of a ceramic base member.

FIGS. 1 to 8 each show an inductor element according to an embodiment of the present invention. FIG. 1 is a perspective view of an outer appearance of the inductor element, and FIG. 2 is a perspective view of a coil incorporated in the element. FIG. 3 is a sectional view taken along a cutting line 11 of FIG. 1, and FIG. 4 is a perspective view showing how a ceramic base member and a coil are separated in a mode of FIG. 3. FIG. 5 is a partial enlarged view of a portion A encircled in FIG. 3, and FIG. 6 is a partial enlarged view of a portion B encircled in FIG. 5. FIGS. 7 and 8 are each sectional views of a part of the ceramic base member (one ceramic layer). Refer to coordinate axes in each figure for information on directions in FIGS. 1 to 8.

An inductor element 10 of FIGS. 1 to 8 includes a ceramic base member 13 and a coil 12 formed in the ceramic base member 13 (see FIGS. 3 and 4). The ceramic base member 13 and the coil 12 are complementary in shape (see FIG. 4). The coil 12 is made up of a conductor and is surrounded by the ceramic base member 13 (magnetic ceramic base member) made of a magnetic member.

The ceramic base member is completed by laminating plural ceramic layers 14. Plural steps 5 are formed on an inner wall surface of the ceramic base member 13 facing to the coil 12 in accordance with a thickness (dimension in a Z direction) of one ceramic layer 14 in the inductor element 10. The dimension of each step 5 is expressed by reference symbol D (see FIG. 7), reference symbol DL (step on the left side of FIG. 8), and reference symbol DR (step on the right side of FIG. 8).

Further, plural steps 5 are formed in the Z direction also on an outer wall surface of the ceramic base member 13, which is not facing to the coil 12 (see FIGS. 3 and 4; omitted from FIG. 5). Further, the steps 5 formed in the Z direction are formed on a surface parallel to an XZ plane as well as a surface parallel to a YZ plane (not shown) of the inner wall surfaces in the inductor element 10.

In the inductor element 10, the ceramic base member 13 and the coil 12 are complementary in shape, and the steps 5 are formed on an inner wall surface of the ceramic base member 13 facing to the coil 12, so steps complementary to the steps 5 formed in the ceramic base member 13 are also formed in the coil 12 (see FIG. 4). Then, in the ceramic base member 13, the steps 5 formed in the Z direction are formed on the surface parallel to the XZ plane as well as to the surface parallel to the YZ plane of the inner wall surfaces, so steps are also formed on a surface parallel to the XZ plane as well as a surface parallel to the YZ plane in the coil 12. The steps are formed on all side surfaces of the coil 12 (see FIG. 2).

As shown in FIGS. 3 and 4, in the inductor element 10, the coil 12 takes a square spiral shape, and its width (dimension in the Y direction) is large, so a resistance generated upon supplying a current in a wiring direction can be reduced. In the inductor element 10, the same coil 12 pattern appears on the XZ plane as a section of the laminated ceramic layers 14. In other words, the coil 12 of the inductor element 10 has such a square spiral shape that a predetermined pattern appears on every section parallel to the XZ plane.

Cutouts 4 are further formed in the same direction as a depth direction of each step 5 on beneath the step 5 in the inductor element 10. The depth direction of each step 5 is an X direction in the step 5 formed on the surface parallel to the YZ plane. In FIG. 5, as for the steps 5 formed on the inner wall surface of the ceramic base member 13 on the left side, the depth direction is a right-handed direction. As for the steps 5 formed on the inner wall surface of the ceramic base member 13 on the right side, the depth direction is a left-handed direction. The dimension of each cutout 4 is expressed by reference symbol KL (cutout on the left side of FIG. 8) and reference symbol KR (cutout on the right side of FIG. 8). In the inductor element 10, the dimension of each cutout 4 is preferably ⅕ to 1/200 of the maximum width of the ceramic base member 13 in the X direction that is the same direction as a depth direction of each cutout 4 (as the depth direction of each step 5). The maximum width of the ceramic base member 13 is denoted by reference symbol W (see FIG. 8).

In the inductor element 10, the steps 5 and the cutouts 4 are formed on both sides of the ceramic base member 13 as described above. The ceramic layers 14 constituting the ceramic base member 13 are not connected but are joined by a supporting portion 3 at the center. The dimension of the supporting portion 3 is denoted by reference symbol C (see FIG. 8).

Preferred examples of the dimension DL of the step 5 on the left side (of FIG. 8), the dimension DR of the step 5 on the right side, the dimension KL of the cutout 4 on the left side, the dimension KR of the cutout 4 on the right side, the dimension C of the supporting portion 3, and the maximum width W of the ceramic base member 13 are given below.

EXAMPLE 1

DL=DR=1.6 μm, KL=KR=3.4 μm, C=10 μm, and W=20 μm. In this case, KL (or KR)/W≅1/5.9.

EXAMPLE 2

DL=DR=1.6 μm, KL=KR=4.9 μm, C=12 μm, and W=25 μm. In this case, KL (or KR)/W≅1/5.1.

EXAMPLE 3

DL=DR=6 μm, KL=KR=6.5 μm, C=25 μm, and W=50 μm. In this case, KL (or KR)/W≅1/7.7.

EXAMPLE 4

DL=DR=1.6 μm, KL=KR=2 μm, C=42.8 μm, and W=50 μm. In this case, KL (or KR)/W=1/25.

EXAMPLE 5

DL=DR=6 μm, KL=KR=20 μm, C=148 μm, and W=200 μm. In this case, KL (or KR)/W=1/10.

EXAMPLE 6

DL=DR=1.6 μm, KL=KR=2 μm, C=192.8 μm, and W=200 μm. In this case, KL (or KR)/W=1/100.

Further, as for the outer dimension of the inductor element 10, a ratio of a length DX of each step 5 in X direction different from the Z direction in which the steps 5 are formed to a length DZ of each step 5 in the Z direction in which the steps 5 are formed is preferably 0.4 to 1.0. Examples of preferred outer dimension are given below together with available examples of an inductance and a DC resistance.

EXAMPLE 7

DX=2.6 mm, DY=1 mm, and DZ=3.2 mm. In this case, DX/DZ≅0.81, and DY/DZ≅0.31. As available inductance and DC resistance, inductance L=10 nH and DC resistance R=0.16 Ω.

EXAMPLE 8

DX=0.81 mm, DY=0.61 mm, and DZ=1.6 mm. In this case, DX/DZ≅0.51, and DY/DZ≅0.38. As available inductance and DC resistance, inductance L=1.2 nH and DC resistance R=0.04 Ω.

Referring also to FIGS. 1 to 8, a method of manufacturing an inductor element according to the present invention is next described taking as an example the case of manufacturing the inductor element 10 illustrated in FIGS. 1 to 8. In all figures including the coordinate axes, the X axis direction and the Y axis direction (XY plane) correspond to a layer direction of the ceramic layers or ceramic green sheets, and the X axis direction corresponds to a direction in which the ceramic layers or ceramic green sheets are laminated.

A first embodiment of manufacturing an inductor element according to the present invention is described first. To manufacture the inductor element (10, 12) ceramic green sheets (see FIGS. 3 and 4) having a predetermined shape and a predetermined thickness and mainly made of a ceramic material are prepared first. The ceramic green sheets (also simply referred to as "sheets") can be manufactured by a conventional ceramic manufacturing method. For example, powder of a magnetic ceramic material is prepared and mixed with a binder, a solvent, a disperser, a plasticizer, or the like at a desired blending ratio to prepare a slurry, followed by degassing to thereby form a sheet by a sheet forming process such as a doctor blade process, a reverse roll coater process, or a reverse doctor roll coater process. Incidentally, a size and shape of the ceramic green sheet may be determined in accordance with a target size of the inductor element.

Next, holes of a predetermined shape are formed in each of the resultant 12 ceramic green sheets by a punching machine including a punch and a die to complete the ceramic green sheets each having a hole formed therein. The respective holes formed in each of the ceramic green sheets form a cavity in such a way that the ceramic green sheets are laminated to form collectively a hole as a whole. The shape of the hole in each ceramic green sheet is set so that the cavity shape corresponds to a desired shape of the coil 12.

Next, the ceramic green sheets with the holes are laminated one on top of the other to form a green laminate. In the resultant green laminate, a hole is formed as a whole to define a cavity corresponding to the shape of coil 12. Thus, if the green laminate is fired, the ceramic base member 13 that serves as a die and has a cavity corresponding to the shape of coil 12 and defined by the cumulatively formed hole is obtained. Twelve sheets of ceramic green sheets are backed to form the ceramic layers 14 composed of twelve laminated punched sheets to thereby complete the ceramic base member 13. At this point, the coil 12 is not yet formed in the ceramic base member 13.

Subsequently, a conductive material is filled by, for example, a dispensing method into the cavity of the ceramic base member 13 that serves as a die and the resultant is fired, thereby the conductive material is formed into the coil 12 and the inductor element 10 is completed. Incidentally, the formation of terminals for establishing connections with the outside or coverage (sealing) with a protective film (insulating film) is optionally performed (the same thing is applicable to the following second embodiment of manufacturing an inductor element according to the present invention, so repetitive description thereof is omitted below).

If the first embodiment of manufacturing an inductor element according to the present invention is used, the coil 12 shape is determined by the cavity shape, and the cavity shape is determined by the hole shape and the thickness of the ceramic green sheet (ceramic layer 14), so these are important in the first embodiment of manufacturing an inductor element according to the present invention. In other words, the shape of the coil 12 is determined by the thickness of one ceramic layer 14 (ceramic green sheet before firing in a manufacturing process) and the shape of the hole formed in one ceramic layer 14 (ceramic green sheet before firing in a manufacturing process). Hence, in the first embodiment of manufacturing an inductor element according to the present invention, it is desirable to set the thickness of the ceramic green sheet (fired ceramic layer 14) in accordance with an intended shape of the coil 12 of the inductor element 10.

According to the first embodiment of manufacturing an inductor element of the present invention, the cavity for forming the coil 12 is defined by the hole collectively formed from each hole formed in each green sheet by punching process as a result of lamination. The hole formed in every sheet by the punching process is tapered due to a difference in dimension between an opening at the inlet and an opening at the outlet (in general, smaller at the outlet). Thus, the step 5 corresponding to the thickness of one ceramic layer 14 is formed on the cavity formation surface (wall surface) of the ceramic base member 13 as a laminate of the ceramic layers 14 formed by firing the sheets (see FIGS. 3 and 4).

Next, the second embodiment of manufacturing an inductor element according to the present invention is described. To manufacture the inductor element 10, 12 ceramic green sheets (see FIGS. 3 and 4) having a predetermined shape and a predetermined thickness and mainly made of a ceramic material are prepared first. The ceramic green sheets can be manufactured by a conventional ceramic manufacturing method as described above.

Next, the hole of a predetermined shape is formed in each of the resultant 12 ceramic green sheets by a punching machine including a punch and a die, and in addition, a conductive material for forming a part of the coil 12 is filled into each hole by a printing method using metal mask photolithography. Through the above steps, the ceramic green sheets having a hole, respectively formed therein and filled with a conductive material are obtained. The hole formed in the respective ceramic green sheets serves as a part to form collectively a cavity by laminating a prescribed number of ceramic green sheets. The conductive material filled into each hole formed in each ceramic green sheet forms a coil 12 as a result of laminating the ceramic green sheets so as to form a hole collectively.

Next, the ceramic green sheets with the holes filled with the conductive material are laminated one on top of the other to form a green laminate. In the resultant green laminate, a hole is collectively formed to define a cavity corresponding to the coil 12 shape. At this point, the conductive material for forming the coil 12 later is already filled in the cavity. Thus, if the green laminate is fired, the conductive material is formed into the coil 12 to complete the inductor element 10. The 12 ceramic green sheets are backed to form the 12 ceramic layers 14 to thereby complete the ceramic base member 13.

Even in the second embodiment of manufacturing an inductor element according to the present invention, similar to the first embodiment of manufacturing an inductor element according to the present invention, the coil 12 shape is determined by the cavity shape, and the cavity shape is determined by the hole shape and the thickness of the ceramic green sheet (ceramic layer 14), so these are important in manufacturing an inductor element according to the second embodiment of manufacturing an inductor element according to the present invention. In other words, the shape of the coil 12 is determined by the thickness of one ceramic layer 14 (ceramic green sheet before firing in a manufacturing process) and the shape of the hole formed in each ceramic layer 14 (ceramic green sheet before firing in a manufacturing process). Hence, in the second embodiment of manufacturing an inductor element according to the present invention, it is desirable to set the thickness of the ceramic green sheet (fired ceramic layer 14) in accordance with an intended shape of the coil 12 of the inductor element 10.

Even in the second embodiment of manufacturing an inductor element according to the present invention, the cavity for forming the coil 12 is defined by the hole formed collectively from a hole in each green sheet by a punching process. The hole formed in the sheet by the punching process is tapered due to a difference in dimension between an opening at the inlet and an opening at the outlet (in general, smaller at the outlet). Thus, the step 5 corresponding to the thickness of each ceramic layer 14 is formed on the cavity formation surface (wall surface) of the ceramic base member 13 as a laminate of the ceramic layers 14 formed by firing the sheets (see FIGS. 3 and 4).

In the inductor 10 manufactured by the first or second method of manufacturing an inductor element according to the present invention, the wall portion (real portion) of the ceramic base member 13 that defines the cavity is formed by laminating the ceramic layers 14, and the hole in the ceramic layer 14 (ceramic green sheet before firing in a manufacturing process) can be formed into a simple rectangular shape. Thus, it can be easily formed with a very small thickness. Thus, according to the method of manufacturing an inductor element of the present invention, it is possible to manufacture an inductor element having the coil 12 that occupies a large area of the entire circuit area in the compact size with ease.

Next, materials used for the inductor element according to the present invention are described. As a material (ceramic material) for the ceramic base member (ceramic layer), a magnetic ceramic material of a spontaneous magnetization function, which mainly contains iron oxide, can be used. Examples thereof include a soft magnetic material as spinel-structure ferrite and garnet-structure ferrite, and a hard magnetic material as magnetoplum bite structure ferrite. Specific examples thereof include a material made of oxides of an iron group element generally called "ferrite" ($MFe.O_3$ in a molecular formula), which is a solid solution of Zn-ferrite such as Mn-ferrite or Ni-ferrite ($ZnFe_2O_4$).

As a coil material, conductive noble metal is used. Examples thereof include Ag, Au, Pd, and Pt. Incidentally, the conductive material is mixed with a binder when in use (filled and formed). Examples of the binder include glass fine particles mainly containing oxides such as $SiO_2$, $B_2O_3$, $Na_2O$, PbO, or ZnO.

In the case of partially or completely covering the inductor with a protective film, silicon dioxide, silicon nitride, borophosphosilicate glass (BPSG), and phosphosilicate glass (PSG) may be used as a material for the protective film.

What is claimed is:

1. An inductor element, comprising:

a ceramic base member; and a coil composed of a conductor having a shape complementary to the ceramic base member, wherein a predetermined number of steps are formed on at least an inner wall surface of the ceramic base member facing to the coil in one direction to form a cavity; and wherein said coil substantially fills said cavity.

2. The inductor element according to claim 1, wherein a cutout is formed beneath of each of the steps in the same direction as a depth direction of each of the steps.

3. The inductor element according to claim 2, wherein the cutout has a dimension that is ⅕ to 1/200 of the maximum width of the ceramic base member in the same direction as a depth direction of the cutout.

4. The inductor element according to claim 2, wherein the cutout has a dimension of 2 to 20 μm.

5. The inductor element according to claim 3, wherein the cutout has a dimension of 2 to 20 μm.

6. The inductor element according to claim 1, wherein the inductor element has a square spiral shape.

7. The inductor element according to claim 1, wherein a ratio of a length of each of the predetermined number of steps in another direction different from the one direction in which the predetermined number of steps is formed to a length of each of the predetermined number of steps in the one direction is 0.4 to 1.0.

8. The inductor element according to claim 6, wherein a ratio of a length of each of the predetermined number of steps in another direction different from the one direction in which the predetermined number of steps is formed to a length of each of the predetermined number of steps in the one direction is 0.4 to 1.0.

9. The inductor element according to claim 1, wherein the ceramic base member is a magnetic ceramic base member composed of a magnetic member.

* * * * *